United States Patent [19]

Gabbatiss et al.

[11] Patent Number: 4,981,223

[45] Date of Patent: Jan. 1, 1991

[54] APPARATUS FOR FEEDING BOARDS FROM THE BASE OF THE STACK

[75] Inventors: Terence S. Gabbatiss, Cheadle Hulme; Robert Collins, Wilmslow, both of England

[73] Assignee: Simon Container Machinery Limited, Cheshire, England

[21] Appl. No.: 298,617

[22] Filed: Jan. 18, 1989

[30] Foreign Application Priority Data

Jan. 19, 1988 [GB] United Kingdom ..... 8801100

[51] Int. Cl.[5] ..... B65H 3/08

[52] U.S. Cl. ..... 271/99; 271/105; 271/107; 271/132; 271/134; 414/797.7

[58] Field of Search ..... 271/134, 132, 133, 131, 271/99, 104, 105, 107; 414/797.7, 797.8, 797.9

[56] References Cited

U.S. PATENT DOCUMENTS 1,634,072 6/1927 Bombard et al. ..... 271/134
4,009,876 3/1977 Smiltneek ..... 271/132 X
4,010,944 3/1977 Young ..... 271/134 X
4,657,236 4/1987 Hirakawa et al. ..... 271/99

*Primary Examiner*—Kevin P. Shaver
*Assistant Examiner*—David H. Bollinger
*Attorney, Agent, or Firm*—Nies, Kurz, Bergert & Tamburro

[57] ABSTRACT

Apparatus for feeding boards (10) sequentially in one direction from the base of the stack through a feed gate (11) at the base of a front stack retaining wall (12) comprising a transverse series of perforated reciprocating conveying straps (14) mounted on driven pulleys (15) and interposed between a transverse series of lifting bars (13) with a drive mechanism for lowering and raising the lifting bars (13) sequentially and in synchronization with forwards and rearwards movement respectively of the conveying straps (14). A suction box (17) causes the lowermost board to be held in frictional driving contact with the upper surfaces of conveying straps (14) as the board is conveyed forwards into the nip of a pair of feed rolls (40) of, for example, corrugated board handling machinery.

9 Claims, 3 Drawing Sheets

APPARATUS FOR FEEDING BOARDS FROM THE BASE OF THE STACK

This invention concerns apparatus for feeding boards sequentially in one direction from the base of a stack. The apparatus must be capable of feeding single sheets, one at a time, accurately and without slip into the nip of a pair of feed rolls, for example, in corrugated board handling machinery such as printer slotters, casemakers and rotary die cutters.

Many devices have been proposed for positively feeding boards, using, for example, high friction feed wheels, rollers or endless belts, and the grip of the conveying surface on the boards has been assisted by hold-down vacuum applied beneath the conveyors.

Such systems are prone to slip between the contacting surfaces of the conveyors and the boards which leads to rapid wear of the conveying surfaces, and in the case of wheels there is only line contact with the board so that such wear is rapidly encountered.

A particular difficulty in feeding boards of corrugated paper is that some boards will be warped and so will not necessarily be in contact with the conveying members across the entire width of the board.

The object of the present invention is to provide apparatus for feeding boards from the base of a stack, wherein the aforementioned difficulties are overcome, and to minimise the manufacturing and running costs of such apparatus.

According to the present invention, apparatus for feeding boards sequentially in one direction from the base of a stack through a feed gate at the base of a front stack retaining wall, comprises a transverse series of spaced stack supporting members, a transverse series of spaced parallel conveying members interposed between the supporting members and having conveying surfaces, drive means for advancing and retracting the conveying members in a reciprocating manner, further drive means for raising and lowering the supporting members with respect to the conveying members in a reciprocating manner, the two drive means being synchronised such that the supporting members are sequentially lowered to permit the lowermost board of the stack to be advanced by the conveying members, and then raised to support the stack above the conveying members during retraction of same, and means to apply suction through or past the conveying members to ensure that the board is gripped by the conveying surfaces thereof during feed.

An embodiment of the invention will now be described, by way of example only, with reference to the accompanying drawings in which.

Figure 4:
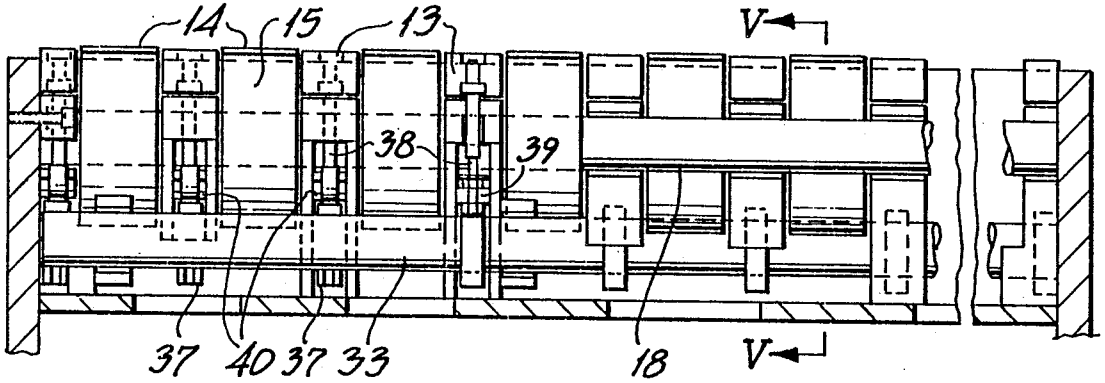
FIG. 4 is a similar view showing some of the parts removed from FIG. 3.
Figure 5:
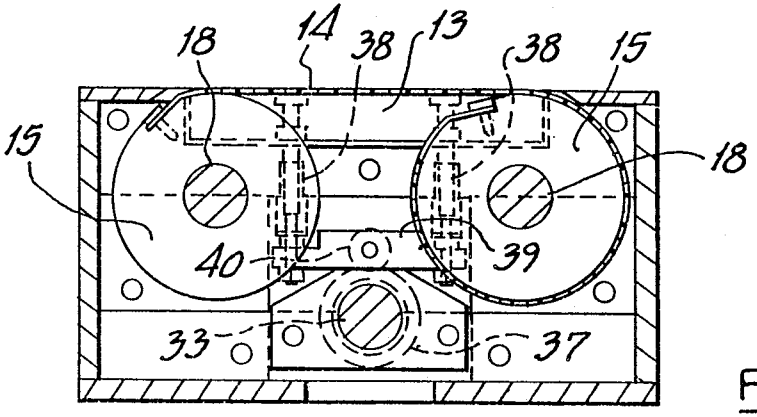

and FIG. 5 is a vertical section taken along line V—V of FIG. 4.

Figure 1:
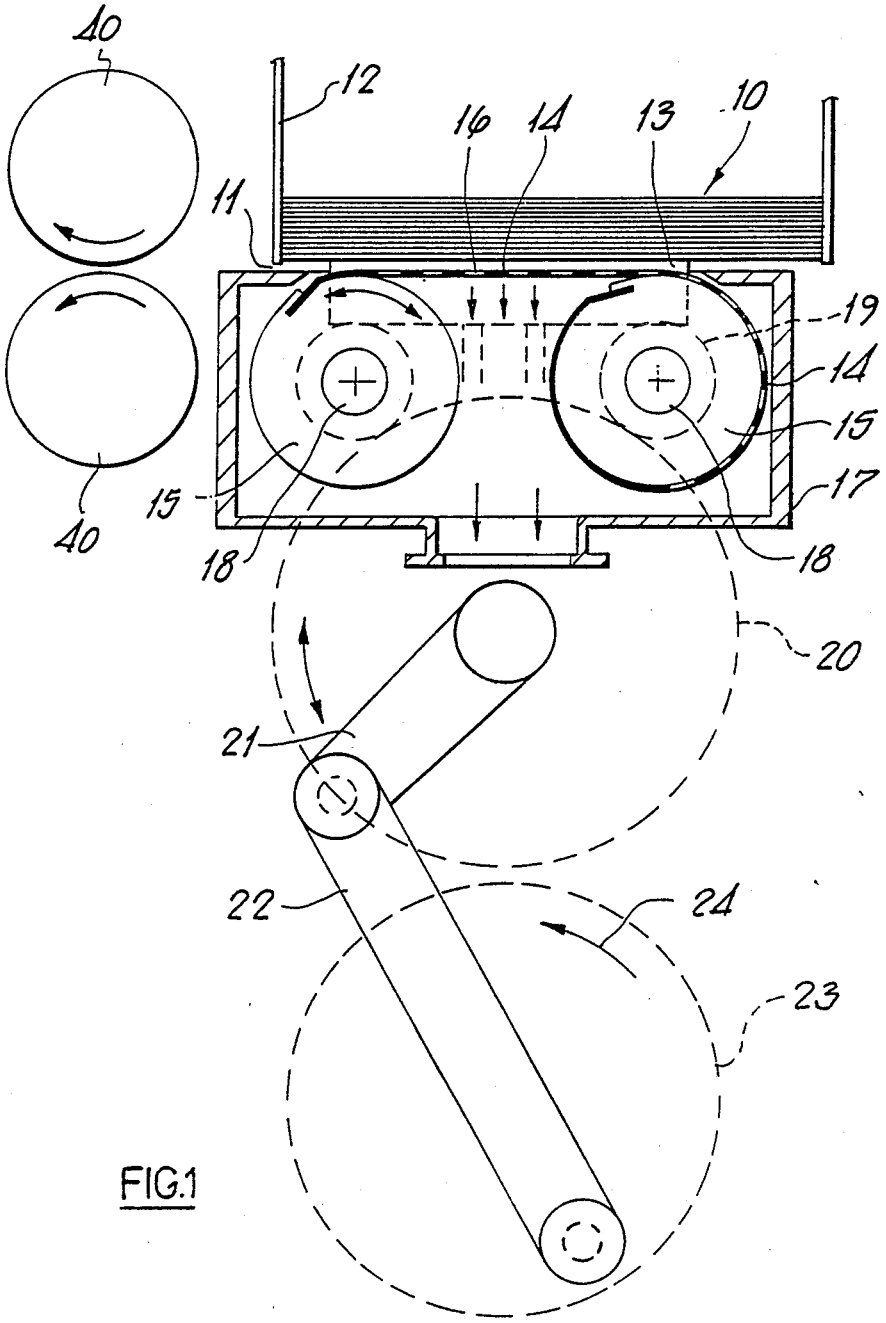
FIG. 1 is a schematic side view of apparatus made in accordance with the invention.

Referring now to the drawings, in FIG. 1 there can be seen a stack of boards 10 from which individual boards are to be fed sequentially through a feed gate 11 at the base of a front wall 12 of a stack retaining hopper. A transverse series of spaced stack supporting members or board lifters 13 support the entire stack in a stationary condition.

Between the spaced parallel board lifters 13 are a plurality of non-continuous straps or belts 14 with their ends attached respectively to the surfaces of two rotatable pulleys 15 so that the straps can spool between them. The straps 14 have spaced perforations 16 and are disposed, together with the pulleys 15, in an upper region of a suction box 17 from which air :s drawn through a outlet at the bottom.

Two rows of pulleys 15 are mounted for rotation on shafts 18 each driven by a gear 19 which meshes with a common gear 20. The gear 20 is driven to and fro in a reciprocating manner by a four bar linkage consisting of pivotally connected links 21 and 22 and a crank disc 23 driven in rotation as indicated by arrow 24 by a main motor driven shaft 25 (see FIG. 3).

Thus, as shaft 25 and disc 23 are driven continuously in one direction the conveying straps 14 are repeatedly advanced from right to left in FIG. 1 and then retracted to the position shown.

As will be described, during this action the board lifters 13 are caused to descend thus to bring the lowermost board of the stack 10 into contact with the conveying straps 14. The four bar linkage ensures that the straps 14 accelerate the board to the required speed before retracting, the lifters 13 being raised as soon as a board is fully advanced through the gate 11, to support the stack during retraction of the straps 14.

As each board is advanced through the gate, it is held down in close contact with all of the straps 14 by the suction applied.

Figure 2:
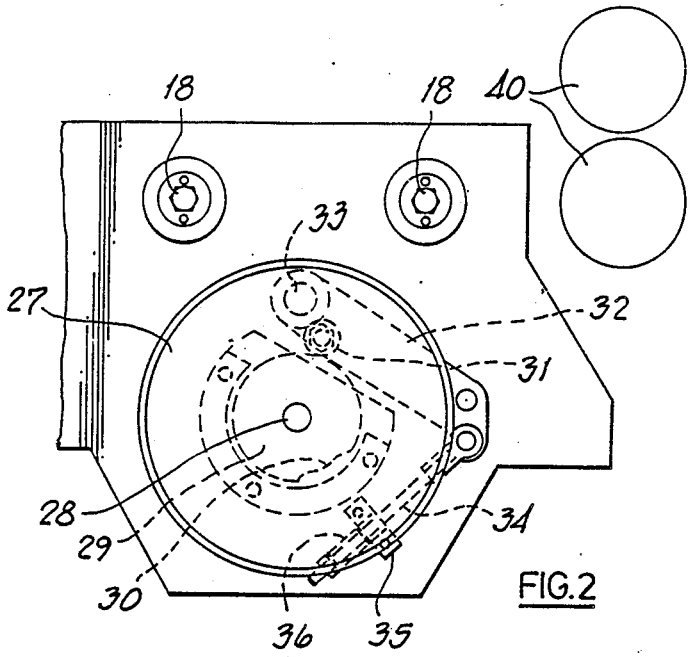
FIG. 2 is a view from the opposite side of the apparatus.
Figure 3:
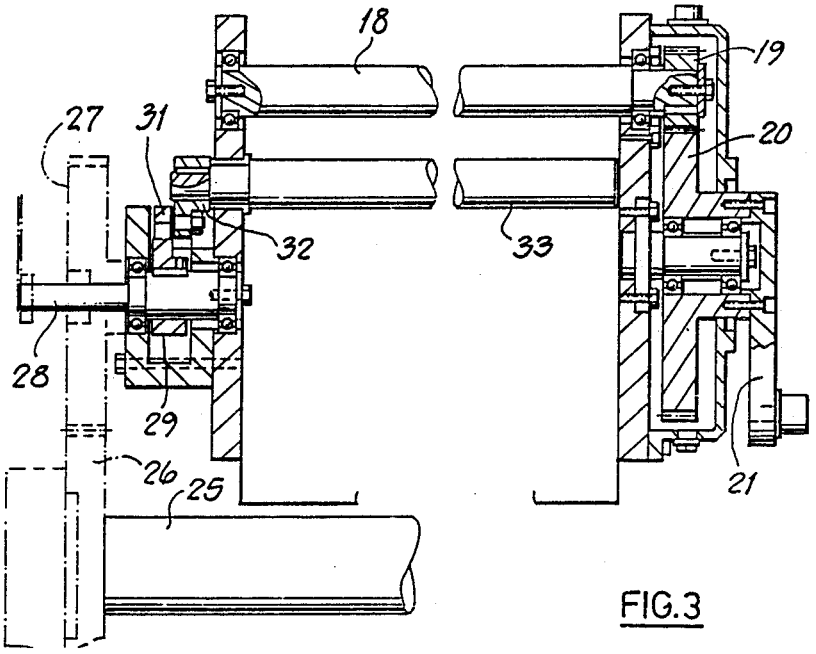
FIG. 3 is a front end view of the apparatus with parts removed for the sake of illustration.

Referring now to FIGS. 2 and 3 where like parts are denoted by like reference numerals, the shaft 25, via gears 26 and 27, also drives a cam shaft 28 on which is fixed a cam 29 which, as can be seen in FIG. 2, presents a short depression 30 into which, during rotation of camshaft 28 a cam follower 31 descends. The follower is mounted on a lever 32 which is keyed onto a shaft 33. Cam follower 31 is held in close contact with the surface of cam 29 by means of a link 34 which passes through a bearing member 35 and carries a compression spring 36 tending to force link 34 towards the lower end of FIG. 2.

Therefore, as follower 31 descends into depression 30 on cam 29, the effect of compression spring 36 is to cause link 32 and thus shaft 33 to rotate by a small degree in a clockwise direction as viewed in FIG. 2.

Referring now to FIG. 4 in which can be seen the conveying straps 14 and board lifters 13, there is also shown shaft 33 which carries a number of lifter cams 37.

Associated with each board lifter 13 there are a pair of lifting pins 38 which are mounted in spaced relationship on a yoke 39 carrying a cam follower 40 which serves to lift the yoke 39, pins 38 and board lifters 13. It is the small rotation of lifter camshaft 33 via lifter cams 37 which causes the board lifters 13 to be raised sufficiently with respect to the surfaces of conveying straps 14 to support the stack of boards above them. The period during which the lifters 13 are raised is determined by the length of the depression 30 in rotating cam 29 and the speed of shaft 28 as determined by the ratio of gears 26 and 27.

In a practical embodiment, the entire assembly as described is placed in front of a pair of driven feed rolls 40 delivering boards to a machine such as a printer slotter, casemaker or rotary die cutter.

The sequence of operation of the apparatus to feed the boards from the stack 10 into the nip of the feed rolls 40 commences with the parts positioned as shown in FIG. 1.

The drive assemblies are synchronised such that the board lifters 13 drop the lowermost board onto the conveyor straps 14 at the moment when the latter commence their forwards stroke. Suction is applied through the apertures 16 to hold the entire width of the board down onto the combined conveying surfaces of the straps 14. The four bar linkage ensures that the board is accelerated by the straps as it passes through the gate 11, to the delivery speed determined by rotation of the feed rolls 40. As soon as the board is taken up by the nip of rolls 40 the board lifters 13 are raised once again to lift the stack clear of the straps 14 to enable them to be retracted by the drive system. During the forwards stroke of the straps 14 the apertures 16 are gradually blanked off by passing onto the surfaces of pulleys 15 such that no further suction is applied once the board is under the influence of feed rolls 40.

As can be seen in FIG. 4, the width of each strap 14 is preferably slightly greater than that of each adjacent board lifter 13. Preferably, the straps 14 are of synthetic rubber whilst the upper surfaces of board lifters 13 may be of metal or a rigid plastics material.

The cam and follower arrangement for raising and lowering the lifting bars may be replaced by a series of pivotal links connecting the lifting bars directly to the reciprocating shaft.

The mechanism is capable of feeding boards at a rate of 170 per minute or more.

We claim:

1. Apparatus for feeding boards sequentially in one direction from the base of a stack through a feed gate at the base of a front stack retaining wall comprising a transverse series of spaced stack supporting members, a transverse series of spaced parallel conveying members interposed between the supporting members and having conveying surfaces, each conveying member being formed by a non-continuous strap or belt having its opposite ends attached respectively to the surfaces of two pulleys such that the straps can spool between them, first drive means for advancing and retracting the conveying members in a reciprocating manner, second drive means for raising and lowering the supporting members with respect to the conveying members in a reciprocating manner, means synchronizing the first and second drive means such that the supporting members are sequentially lowered to permit the lowermost board of the stack to be advanced by the conveying members, and then raised to support the stack above the conveying members during retraction of same, and means to apply suction through or past the conveying members to ensure that the board is gripped by the conveying surfaces thereof during feed.

2. Apparatus according to claim 1, wherein the conveying straps having spaced perforations and are disposed, together with the pulleys, in an upper region of a suction box.

3. Apparatus according to claim 2, wherein during forwards movement of the conveying straps the perforations therein are progressively blanked off by passing on to the surfaces of the pulleys, thus progressively reducing the suction applied to a board as it is conveyed forwardly.

4. Apparatus according to claim 1 or claim 2, wherein said pulleys are disposed in two rows mounted for rotation on a pair of parallel shafts driven by said first drive means to accelerate the straps in one direction to a predetermined conveying speed.

5. Apparatus according to claim 1, wherein the second drive means for raising and lowering the supporting members comprises a reciprocating shaft drivingly connected to each of a series of stack lifting bars, further means being provided to determine the timing and duration of lift of the lifting bars in relation to movement of the conveying members.

6. Apparatus according to claim 1, wherein synchronization of the two drive means is so arranged that the supporting members descend to deposit the lowermost board onto the conveying members at the moment when the latter commence a forwards movement, and rise to support the next succeeding board of the stack as soon as the previous board is fully advanced through said feed gate whereupon the conveying members are retracted.

7. Apparatus according to claim 1, wherein the conveying members are of a synthetic rubber, and the upper surfaces of the stack supporting members are of metal or of a rigid plastics material.

8. Apparatus according to claim 1, wherein the width of each conveying member is greater than each of the interposed stack supporting members.

9. Apparatus according to claim 1, wherein the speed of operation of the two drive means is such that boards may be fed at a rate of 170 per minute or more.

* * * * *